United States Patent [19]

Budzich

[11] Patent Number: 4,523,431

[45] Date of Patent: Jun. 18, 1985

[54] LOAD RESPONSIVE SYSTEM

[75] Inventor: Tadeusz Budzich, Moreland Hills, Ohio

[73] Assignee: Caterpillar Tractor Co., Peoria, Ill.

[21] Appl. No.: 580,971

[22] Filed: Feb. 16, 1984

[51] Int. Cl.[3] ..... F04B 49/00; F15B 11/02; F15B 15/18

[52] U.S. Cl. ..... 60/431; 60/423; 60/468; 417/34

[58] Field of Search ..... 137/596.12, 596.13; 60/423, 431, 468, 911; 417/15, 34

[56] References Cited

U.S. PATENT DOCUMENTS

| | | | |
|---|---|---|---|
| 2,942,421 | 6/1960 | Hann et al. | 60/423 |
| 3,159,965 | 12/1964 | Woolley et al. | 60/431 |
| 3,444,689 | 5/1969 | Budzich | 60/427 |
| 3,447,556 | 6/1969 | Howeth | 417/34 X |
| 3,488,953 | 1/1970 | Haussler | 137/596.13 X |
| 3,875,747 | 4/1975 | Briggs | 60/423 X |
| 3,987,625 | 10/1976 | Swatty et al. | 60/431 |
| 4,037,621 | 7/1977 | Budzich | 137/596.13 |
| 4,070,857 | 1/1978 | Wible | 60/431 X |
| 4,118,149 | 10/1978 | Hagberg | 60/431 X |
| 4,373,850 | 5/1983 | Durham | 60/431 X |

FOREIGN PATENT DOCUMENTS

| | | | |
|---|---|---|---|
| 2751663 | 5/1978 | Fed. Rep. of Germany | 60/431 |

*Primary Examiner*—Irwin C. Cohen
*Attorney, Agent, or Firm*—J. W. Burrows

[57] ABSTRACT

A load responsive fluid power and control system in which the speed of the prime mover, driving a fixed displacement pump, is varied to maintain a constant pressure differential between pump discharge pressure and maximum system load pressure, above a certain predetermined system flow level and in which this constant pressure differential is maintained by pump flow bypass control, at system flows below this predetermined level.

21 Claims, 3 Drawing Figures

LOAD RESPONSIVE SYSTEM

BACKGROUND OF THE INVENTION

This invention relates generally to load responsive fluid power and control systems, in which the flow out of the pump is automatically varied to maintain a constant pressure differential between the discharge pressure of the pump and the maximum system load pressure.

In more particular aspects this invention relates to load responsive fluid power and control systems, in which the flow of the pump is varied by a bypass control.

In still more particular aspects this invention relates to a load responsive fluid power and control system, in which the flow out of the system pump is varied by variation in the rotational speed of the prime mover driving the pump.

Load responsive fluid power and control systems are very desirable, since they provide an exact and accurate proportional control of system loads. Such systems may use an inexpensive fixed displacement system pump, usually driven at a constant speed and provided with a bypass type output flow control, as disclosed in U.S. Pat. No. 3,488,953, issued to Haussler. Although such a system provides high performance at low cost, it is comparatively inefficient especially with a duty cycle utilizing low system flows at high pressure. This drawback can be overcome by a system as disclosed in U.S. Pat. No. 3,444,689, issued to Budzich, in which the flow output of the pump is varied by change in the pump displacement, in response to a load pressure signal. Such a system is very efficient but, since it uses a variable displacement pump, it becomes relatively expensive.

SUMMARY OF THE INVENTION

It is therefore the principal object of this invention to provide a highly efficient low cost load responsive system using a fixed displacement pump, the flow output of which, in the range of higher pump flows, is controlled by the variation in the speed of the prime mover, driving the pump, in response to the load pressure signal.

Another object of this invention is to provide a highly efficient, low cost load responsive system, in which, in the range of lower pump flows, associated with the minimum idling speed of the prime mover, the flow out of the pump is varied by a bypass flow control, in response to the load pressure signal.

It is a further object of this invention to vary the flow out of a fixed displacement pump by change in its rotational speed, to maintain a constant pressure differential between the pump discharge pressure and the maximum system load pressure.

It is a further object of this invention to provide a bypass flow control, to vary the flow out of a fixed displacement pump in the range of low rotational speeds of the pump and to make said bypass flow control inactive and to control the flow out of the pump, by change in the rotational speed of the pump, in the range of higher rotational speeds of the pump, associated with higher pump flow.

It is a further object of this invention to provide variable speed control of a fixed displacement pump responsive to the control output from the bypass flow control.

It is a further object of this invention to dissipate the flow peaks, associated with sudden reduction in the flow control, while the rotational speed of the pump is being lowered.

Briefly the foregoing and other addional objects and advantages of this invention are accomplished by providing a novel highly efficient, flow changing control of a fixed displacement pump, in which, in the idling speed range of the pump, at low horsepower levels, the less efficient bypass flow control is used, while in the range of higher pump speeds, equivalent to higher horsepower outputs, the flow output of the pump is controlled in a very efficient way, by change in the rotational speed of the pump. The flow out of the pump, in those two modes of control operation, is varied to maintain a constant pressure differential between the pump discharge pressure and maximum system load pressure, which is characteristic of a load responsive system.

Additional objects of this invention will become apparent when referring to the preferred embodiments of the invention as shown in the accompanying drawings and described in the following detailed description.

DESCRIPTION OF THE PREFERRED EMBODIMENTS

Figure 1:
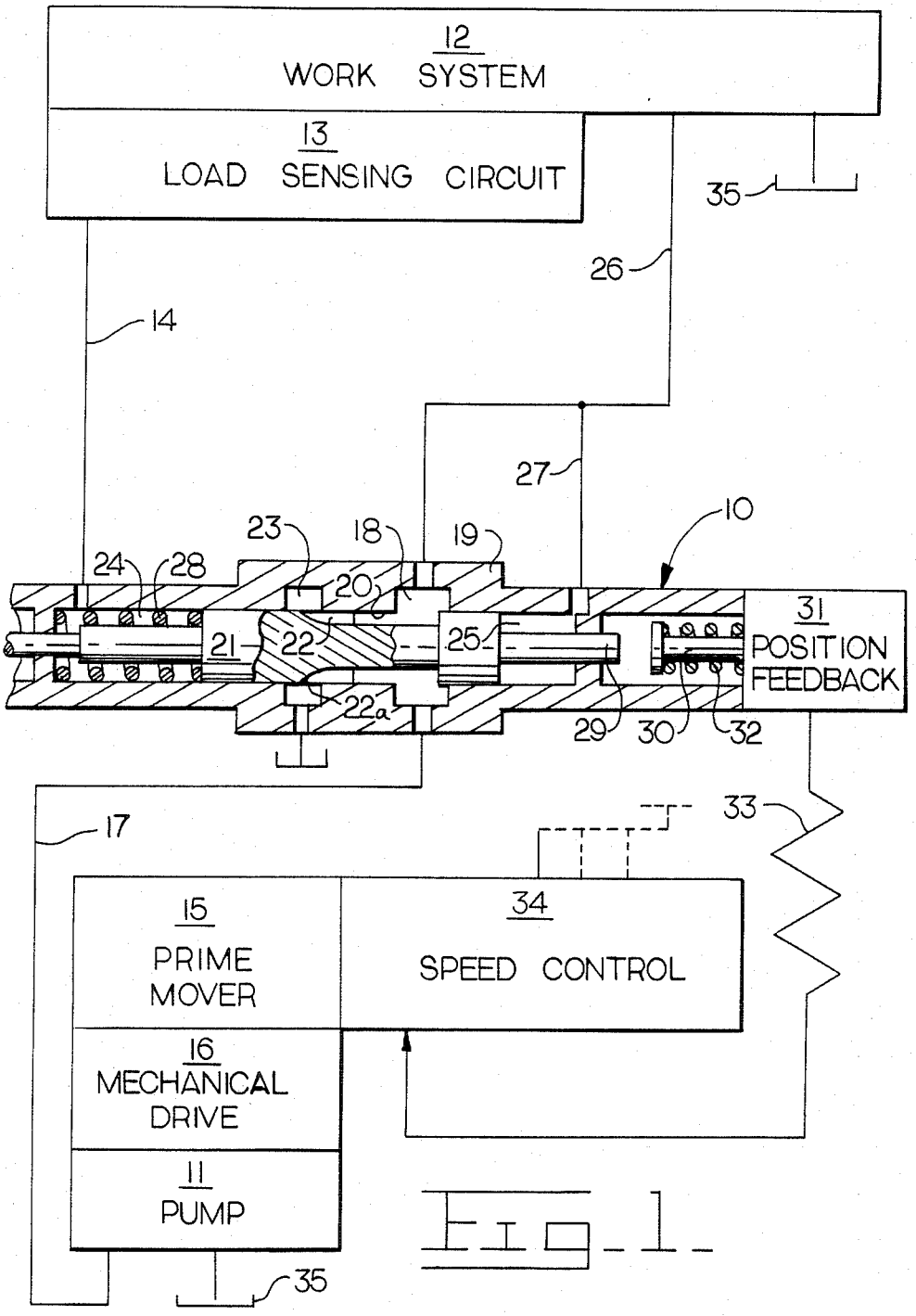
FIG. 1 is a longitudinal sectional view of a differential pressure bypass flow control with the hydraulic system, load signal transmitting circuit, signal generating circuit, prime mover speed control, prime mover, mechanical drive, fixed displacement pump and system reservoir shown diagrammatically.

Referring now to FIG. 1, an embodiment of a load responsive bypass valve assembly, generally designated as 10, is interposed between fixed displacement pump 11 and schematically shown load responsive system 12, provided with schematically shown load sensing circuit 13, operable to transmit maximum load pressure signal to the bypass valve 10 through line 14. The fixed displacement pump 11, driven by a prime mover 15, through a mechanical drive 16, is connected by a discharge line 17 with the inlet core 18, of the bypass valve 10, which in turn is connected to the load responsive system 12. The bypass valve 10 has a housing 19, provided with a bore 20, slidably guiding a bypass spool 21, provided with throttling slots 22, terminating in throttling edges **22*a*, controlling by throttling the bypass flow between the inlet core 18 and exhaust core 23. The bypass spool 21 defines in respect to bore 20 spaces 24 and 25. Space 25 is connected with inlet core 18 through lines 26 and 27 and therefore communicates directly with the discharge pressure of pump 11. Space 24 is connected by line 14 to the maximum load pressure of load responsive system 12 and contains control spring 28, biasing the bypass spool 21 towards position, in which communication between inlet core 18 and exhaust core 23 is disrupted. The bypass spool 21 is provided with extension 29, which selectively engages an actuator rod 30, of a position signal generator 31. The actuator rod 30 is biased towards position as shown by a spring 32. The position signal generator 31 is connected through a signal transmitting mechanism 33 with a speed control 34 of the prime mover 15. The pump 11 and the load responsive system 12, in a well known manner, are connected to a system reservoir 35**.

Figure 2:
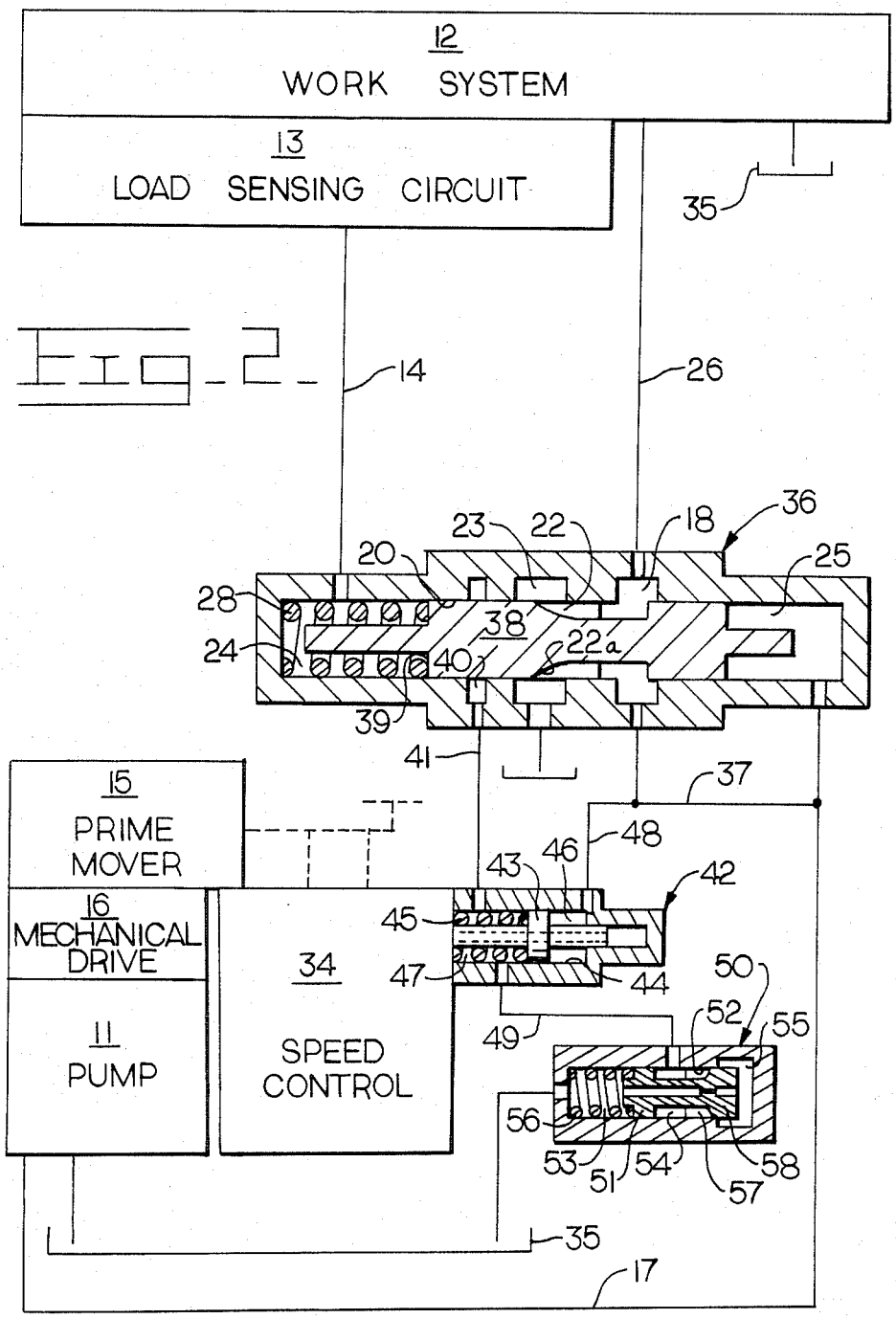
FIG. 2 is a longitudinal sectional view of a differential pressure bypass flow control, together with the actuating mechanism of the control of prime mover speed and leakage flow control with the hydraulic system, load signal transmitting circuit, prime mover speed control, prime mover, mechanical drive, fixed displacement pump and system reservoir shown diagrammatically.

Referring now to FIG. 2, like components of FIGS. 1 and 2 are designated by like numerals. A bypass valve, generally designated as 36, is interposed between the fixed displacement pump 11 and schematically shown load responsive system 12, provided with schematically shown load sensing circuit 13, operable to transmit maximum load pressure signal to the bypass valve 36. The pump 11 is connected through line 17 and line 37 with core 18, while also being connected by line 17 with space 25. A bypass spool 38 is provided with a timing surface 39, selectively communicating space 24 with control core 40, which in turn is connected by line 41 with an actuating control, generally designated as 42. The actuating control 42, provided with a piston 43, slidably guided in bore 44 and biased by a spring 45, defines spaces 46 and 47. Space 46 is connected by lines 17, 37 and 48 to the pump discharge pressure. Space 47 is connected by line 41 with the control core 40 and also connected by line 49 with a constant leakage control, generally designated as 50. The constant leakage control 50 is provided with a metering spool 51, guided in bore 52, which defines spaces 53, 54 and 55. The metering spool 51 is biased by a spring 56 and is provided with throttling slots 57 and metering orifice 58.

Figure 3:
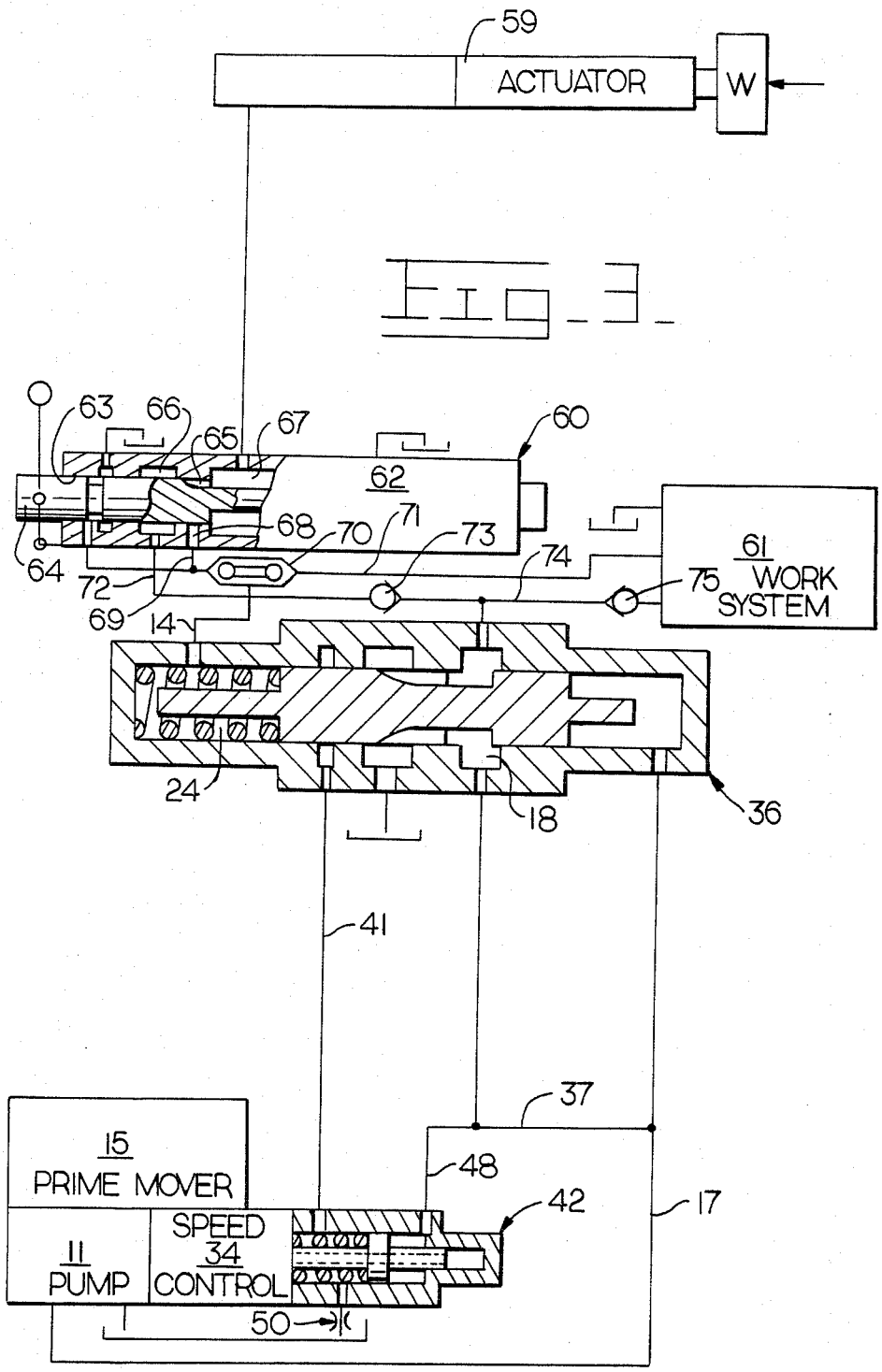
FIG. 3 is essentially the arrangement of FIG. 1 with the components of the hydraulic system shown in greater detail and including a partial longitudinal sectional view of the direction control valve.

Referring now to FIG. 3, like components of FIGS. 1, 2 and 3 are designated by like numerals. The diagrammatically shown load sensing circuit 12 of FIGS. 1 and 2 is shown in detail in FIG. 3 and consists of a fluid power actuator 59 controlling a load W, a direction control valve, generally designated as 60, and another schematically shown load responsive system 61. The direction control valve 60 is provided with a housing 62, slidably guiding, with bore 63, a direction control spool 64, provided with throttling slots 65, selectively interconnecting inlet core 66 with load core 67. Load pressure sensing port 68 is connected through line 69, a shuttle valve 70 and line 14 with space 24. The shuttle valve 70 is also connected by line 71 with the load sensing circuit of load responsive system 61. Inlet core 66 of the direction control valve 60 is connected by line 72 and a load check 73 with inlet core 18, which in turn is connected by line 74 and a load check 75 with load responsive system 61.

Referring back now to FIG. 1, the load responsive system 12, well known in the art, may be composed of a number of fluid power actuators, controlling the system loads, each actuator being controlled in turn by a load responsive direction control valve, provided with load pressure sensing ports. Load pressure signals, from such load sensing ports, are connected by a load sensing circuit, which through a series of check valves in a manner, well known in the art, transmits the maximum load pressure signal to the pump flow control. Such a maximum load pressure signal is transmitted from the load sensing circuit 13 through line 14 to the load responsive bypass valve 10. The bypass spool 21, of the bypass valve 10, is subjected on one end to the maximum system load pressure in space 24 and the biasing force of spring 28, while on the other side being subjected to the force, generated by pump discharge pressure in space 25. In a well known manner, while subjected to those forces, the bypass spool 21 will automatically assume a certain throttling position, in which it will throttle, by throttling slots 22, the bypass flow between the inlet core 18 and exhaust core 23, to maintain a constant pressure differential between the pump discharge pressure and the maximum system load pressure. As is well known in the art, this constant pressure differential will be proportional to the preload of the spring 28. With the flow demand of the load responsive system 12 rising, the bypass spool 21 will move from left to right, progressively throttling a smaller bypass flow. With the flow demand of the load responsive system 12 equal to the output of the fixed displacement pump 11, the throttling edges **22*a* will isolate the inlet core 18 from the exhaust core 23 and the full flow of pump 11 will be delivered to the load responsive system 12**.

Assume that under those conditions the fixed displacement pump 11 is driven through the mechanical drive 16 by the prime mover 15 at its minimum or idling speed. Any increase in flow demand of load responsive system 12 will, by exceeding the flow output of the pump 11, automatically lower the pump discharge pressure in space 25. The bypass spool 21, biased by spring 28, will move further from left to right to a point, at which the extension 29 will engage the actuating rod 30. The displacement of the actuating rod 30 will generate, through position signal generator 31, a proportional control signal, which will be transmitted through the signal transmitting mechanism 33 to the speed control 34, of the prime mover 15. It should be noted that the position signal generator 31 can be of a mechanical, fluid powder or electrical type and that it will transmit a control signal proportional to the displacement of the actuating rod 30, through the signal transmitting mechanism 33, which can be of any type well known in the art, to the speed control 34. The prime mover 15 can be an internal combustion engine, or a variable speed electric motor and the speed control 34 can be of any type, capable of proportionally changing rotational speed of the prime mover, in response to an external control signal and maintaining the speed at any specific level, proportional to the signal. Therefore, once the maximum flow capacity of the pump 11, driven at minimum idling speed, is reached, the bypass action of the bypass valve 10 ceases and the control of the pressure differential, between the discharge pressure of the pump and the maximum system load pressure, is accomplished by variation in the pump RPM. The displacement of the actuating rod 30 from left to right, in a manner as described above, will gradually increase the rotational speed of the prime mover and the pump from minimum idling speed to maximum speed. Therefore in the zone of small pump flow, equivalent to idling speed of the prime mover 15, the flow delivered to the load responsive system 12 is regulated by the bypass action of the bypass valve 10, to maintain a relatively constant pressure differential between the pump discharge pressure and the maximum system load pressure. In the range of higher flows, then those equivalent to the idling speed of the pump, this pressure differential is maintained relatively constant by variation in the flow output of the pump, caused by the change in the rotational speed of the prime mover, since the output flow of a fixed displacement pump is directly proportional to its rotational speed.

As is well known in the art the control of pump flow through a bypass operation is comparatively inefficient, with a large amount of fluid power energy being converted to heat. On the other hand the variation in the pump flow output by a change in its speed of rotation is extremely efficient, since none of its output flow is throttled.

Assume that the idling speed of the prime mover is equal to 25% of its maximum working speed. Then the inefficient bypass control will only be used in the small horsepower range of the system, while in the highest horsepower range the control of the constant pressure differential is accomplished in the most efficient way, by control of the rotational speed of the fixed displacement pump.

In the system of FIG. 1 the response to a sudden increase in the demand of the load responsive system 12, at pump flows higher than those equivalent to its idling speed, will strictly depend on the response of the prime mover to its speed control. A sudden reduction in the flow demand, of the load responsive system 12, will put the bypass valve 10 into bypass condition, while the speed of the prime mover is being lowered, producing a much faster responding control. This bypass condition will cease as soon as the rotational speed of the prime mover is reduced to the level, equivalent to the output flow of the pump, equal to the system demand.

Referring now to FIG. 2, the performance of the control system of FIG. 2 is identical to that of FIG. 1 and the system is using similar control components. The operation of the system of FIG. 2, while bypassing flow at idling speeds of pump 12, is identical to that of FIG. 1. The bypass valve 36 regulates the bypass flow to maintain a constant pressure differential between pump discharge pressure and maximum system load pressure. Once the flow demand of the load responsive system 12 exceeds the capacity of the system pump, driven at idling speed, the bypass spool 38 moves into position, in which it isolates by throttling edges 22*a* inlet core 18 from exhaust core 23, while connecting, by timing surface 39, the control space 24 with the control core 40. Under those conditions the maximum load pressure from space 24 is connected through line 41 with space 47, while space 46 is connected through lines 48, 37 and 17 with the pump discharge pressure. The piston 43 will then control the speed control 34 and the rotational speed of the prime mover 15, to maintain a constant pressure differential between pump discharge pressure and maximum system load pressure, as dictated by the preload in the spring 45. Space 47 is also connected through constant leakage control 50 with system reservoir 55. In a well known manner constant leakage control 50, with its metering spool 51, having metering slots 57, throttles the fluid flow from space 54, to maintain space 55 at a constant pressure level, as dictated by the preload of the spring 56. In a well known manner constant flow will pass from space 55, through orifice 58, to space 53 and therefore the system reservoir 35. Therefore with control core 40 isolated by bypass spool 38, subjected to pump discharge pressure the piston 43 will move all the way to the left, compressing the spring 45 and reducing the rotational speed of the prime mover 15 at a constant speed, equivalent to the constant rate of flow through the constant leakage control 50.

Referring now to FIG. 3, the bypass valve 36 and the actuating control 42, of the speed control 34, are identical to that of FIG. 2. The system of FIG. 3 performs in an identical way as the systems of FIGS. 1 and 2. FIG. 3 shows the components of the schematically shown load responsive system 12 and load sensing circuit 13 of FIGS. 1 and 2. A direction control valve 60 is interposed between bypass valve 36 and the fluid actuator 59. The displacement of direction control spool 64 to the left creates a metering orifice through throttling slot 65, between load core 67 and inlet core 66. In a manner as previously described, the control system of FIG. 3 will maintain a constant pressure differential between the load core 67 and inlet core 66 and across the orifice created by displacement of the throttling slots 66, either by bypassing action of the bypass valve 36, or by change in rotational speed of the fixed displacement pump 11. The maximum load pressure signal, either from direction control valve 60 or load responsive system 61, in a well known manner, will be transmitted through the action of the shuttle valve 70 to space 24, of the bypass valve 36.

There are two basic typs of load sensing systems known in the art. In one system a variable displacement pump automatically varies the output flow in response to maximum load pressure signal to maintain a constant pressure differential between pump discharge pressure and the maximum load pressure. In the other system a fixed displacement pump driven, at a constant maximum speed of rotation, provided with a bypass flow control, is used. The bypass flow control is made responsive to the maximum load pressure signal and controls the flow delivered to the hydraulic power circuit to maintain a constant pressure differential between pump discharge pressure and the maximum system load pressure. From a performance standpoint both of those load responsive systems are identical. The basic difference between those two load responsive systems is in their efficiency. The system using a variable displacement pump is one of the most efficient systems known, while the load responsive system using fixed displacement pump is comparatively inefficient. The load responsive system, using a fixed displacement pump, is commonly used, in spite of its inefficiency, because of the low cost and high reliability of fixed displacement pumps.

In the system of this invention a fixed displacement pump is provided with a bypass control which, as previously described, operates only in the flow range, corresponding to low horsepower, producing comparatively small throttling losses. At higher flow outputs the pump flow is varied by the rotational speed of the prime mover, to maintain a constant pressure differential between the pump discharge pressure and the maximum load pressure. In this mode of operation, corresponding to high horsepower range, this system efficiency exceeds the efficiency of the system using a variable displacement pump. The power unit, consisting of a variable speed prime mover and fixed displacement pump, operates in a load responsive system at this maximum efficiency level throughout its entire speed range from idling to maximum RPM, which corresponds to the zone of maximum generation and utilization of power.

Although the preferred embodiments of this invention have been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. A fluid power and control system including load actuating means subjected to load pressure, pump means driven by a variable speed prime mover, means selectively communicating said pump means with said actuating means, and rotational speed control means of said prime mover, means operable to transmit load pressure signal from said actuating means to said rotational speed control means, means operable to transmit a pump discharge pressure signal from said pump means to said rotational speed control means, outlet flow bypass means associated with said pump means and being active to bypass flow, control means of said bypass means having means operable to vary the bypass flow to maintain a relatively constant pressure differential between said discharge pressure and said load pressure when said prime mover means works at a certain minimum rotational speed, and means in said rotational speed control means operable to vary the rotational speed of said prime mover to maintain a relatively constant pressure differential between said discharge pressure of said pump means and said load pressure, said means in said rotational speed control means being sequentially responsive to said outlet flow bypass means being inactive above said certain minimum rotational speed.

2. A fluid power and control system as set forth in claim 1 wherein said prime mover is an internal combustion engine.

3. A fluid power and control system as set forth in claim 1 wherein said prime mover is a variable speed electric motor.

4. A fluid power and control system as set forth in claim 1 wherein said pump means is a fixed displacement pump.

5. A fluid power and control system including load actuating means subjected to load pressure, pump means driven by a variable speed prime mover, means to selectively communicate said pump means and said actuating means, bypass means interposed between said pump means and said actuating means and being active to bypass flow, first control means having first means operable through said bypass means to vary flow delivered from said pump means to said actuating means to maintain a relatively constant pressure differential between the discharge pressure of said pump means and said load pressure below a certain predetermined flow level of said system, and second control means having rotational speed changing means of said prime mover in response to a control signal and second means operable through said rotational speed changing means to vary the rotational speed of said prime mover and flow output of said pump means to maintain a relatively constant pressure differential between said discharge pressure of said pump means and said load pressure above said certain predetermined flow level of said system, said second control means being sequentially responsive to bypass means being inactive above said certain predetermined flow level of said system.

6. A fluid power and control system as set forth in claim 5 wherein said actuating means includes fluid power cylinder means.

7. A fluid power and control system as set forth in claim 5 wherein said means to selectively communicate said pump means and said actuating means includes direction control fluid throttling valve means.

8. A fluid power and control system as set forth in claim 5 wherein said bypass means includes a bypass valve means operable to regulate the bypass flow between said pump means and a system reservoir.

9. A fluid power and control system as set forth in claim 5 wherein said second means has means responsive to said first means and control signal transmitting means operable to transmit the control signal to said rotational speed changing means.

10. A fluid power and control system as set forth in claim 9 wherein said signal transmitting means includes fluid power transmitting means.

11. A fluid power and control system as set forth in claim 9 wherein said signal transmitting means includes mechanical signal transmitting means.

12. A fluid power and control system as set forth in claim 11 wherein said signal transmitting means includes electrical signal transmitting means.

13. A fluid power and control system as set forth in claim 5 wherein sequencing means are interposed between said first and second means, said sequencing means operable to control the pressure differential between said discharge pressure and said load pressure by said first means below a certain predetermined system flow level and to control said pressure differential by said second means above a certain predetermined system flow level.

14. A fluid power and control system as set forth in claim 13 wherein said first means has bypass spool means and said sequencing means has means responsive to position of said bypass spool means.

15. A fluid power and control system as set forth in claim 5 wherein said prime mover is an internal combustion engine.

16. A fluid power and control system as set forth in claim 5 wherein said prime mover is a variable speed electric motor.

17. A fluid power and control system as set forth in claim 5 wherein said pump means is a fixed displacement pump.

18. A fluid power and control system as set forth in claim 5 wherein said first means includes first deactivating means operable to deactivate said first means above said predetermined flow level.

19. A fluid power and control system as set forth in claim 5 wherein said first means includes second deactivating means operable to deactivate said second means below said predetermined flow level.

20. A fluid power and control system as set forth in claim 5 wherein said rotational speed changing means of said prime mover includes control means operable to vary rotational speed of said prime mover proportionally to said control signal.

21. A fluid power and control system as set forth in claim 5 wherein said first means has means responsive to a sudden reduction in flow demand that may occur during operation of the system above said certain predetermined flow level.

* * * * *

UNITED STATES PATENT AND TRADEMARK OFFICE

CERTIFICATE OF CORRECTION

PATENT NO. : 4,523,431

DATED : June 18, 1985

INVENTOR(S) : Tadeusz Budzich

It is certified that error appears in the above-identified patent and that said Letters Patent is hereby corrected as shown below:

Claim 12, line 2, delete "11" and substitute therefor --9--.

Signed and Sealed this

*Nineteenth* Day of *November 1985*

[SEAL]

*Attest:*

DONALD J. QUIGG

*Attesting Officer*

*Commissioner of Patents and Trademarks*